US008237443B2

(12) United States Patent
Hopmann et al.

(10) Patent No.: US 8,237,443 B2
(45) Date of Patent: Aug. 7, 2012

(54) POSITION SENSOR FOR A DOWNHOLE COMPLETION DEVICE

(75) Inventors: Don A. Hopmann, Alvin, TX (US); Daniel M. Cousin, Humble, TX (US); Levon H. Yeriazarian, Katy, TX (US); Juan P. Franco, Houston, TX (US); Ahmed J. Jasser, Houston, TX (US); Priyesh Ranjan, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 673 days.

(21) Appl. No.: 12/264,318

(22) Filed: Nov. 4, 2008

(65) Prior Publication Data

US 2009/0128141 A1 May 21, 2009

Related U.S. Application Data

(60) Provisional application No. 60/988,460, filed on Nov. 16, 2007.

(51) Int. Cl.
*G01V 3/18* (2006.01)

(52) U.S. Cl. ..... 324/325; 324/324; 324/306; 324/204; 137/38; 261/137

(58) Field of Classification Search ..... 324/346, 324/333, 221, 325, 324
See application file for complete search history.

(56) References Cited

U.S. PATENT DOCUMENTS 5,606,256 A * 2/1997 Takei ..... 324/207.21
5,666,050 A 9/1997 Bouldin et al.
5,732,776 A 3/1998 Tubel et al.
5,936,448 A * 8/1999 Ohie et al. ..... 327/205
6,041,857 A 3/2000 Carmody et al.
6,100,681 A * 8/2000 Tsuruta ..... 324/207.2
6,334,486 B1 * 1/2002 Carmody et al. ..... 166/53
6,452,390 B1 * 9/2002 Wollin ..... 324/306
6,509,732 B1 * 1/2003 Rhodes et al. ..... 324/207.12
6,563,306 B2 * 5/2003 Sato ..... 324/207.2
6,586,927 B2 * 7/2003 Pfeil et al. ..... 324/207.2
6,736,213 B2 5/2004 Bussear et al.

(Continued)

FOREIGN PATENT DOCUMENTS

EP 1967689 A2 9/2008
EP 1995406 A1 11/2008

OTHER PUBLICATIONS

Daniels, Jim, et al., "High Density CCL Memory Tool to Confirm SSD Sleeve Position", SPE 68362, Mar. 2001, 1-9.

(Continued)

*Primary Examiner* — Richard Isla Rodas
(74) *Attorney, Agent, or Firm* — Cantor Colburn LLP

(57) ABSTRACT

The position of a movable downhole component such as a sleeve in a choke valve is monitored and determined using an array of sensors, preferably Hall Effect sensors that measure the strength of a magnetic field from a magnet that travels with the sleeve. The sensors measure the field strength and output a voltage related to the strength of the field that is detected. A plurality of sensors, with readings, transmits signals to a microprocessor to compute the magnet position directly. The sensors are in the tool body and are not mechanically coupled to the sleeve. The longitudinal position of the sleeve is directly computed using less than all available sensors to facilitate the speed of transmission of data and computation of actual position using known mathematical techniques.

18 Claims, 16 Drawing Sheets

U.S. PATENT DOCUMENTS

| | | | | |
|---|---|---|---|---|
| 6,848,189 | B2 | 2/2005 | Moake et al. | |
| 6,992,479 | B2 * | 1/2006 | Lequesne et al. | 324/207.21 |
| 7,030,604 | B1 * | 4/2006 | Dmytriw et al. | 324/207.12 |
| 7,521,923 | B2 * | 4/2009 | May et al. | 324/207.24 |
| 7,733,086 | B2 * | 6/2010 | Prammer et al. | 324/303 |
| 7,872,474 | B2 * | 1/2011 | Pusiol et al. | 324/306 |
| 2004/0255479 | A1 | 12/2004 | Moake et al. | |
| 2005/0189938 | A1 * | 9/2005 | Schley et al. | 324/207.15 |

OTHER PUBLICATIONS

Sarian, Serko, et al., "Wireline Evaluation technology in HPHT Wells", SPE 97571, May 2005, 1-10.

Williamson, Jim R., et al., "An Infinitely Variable Choke for Multi-Zone Intelligent Well Completions", SPE 64280, Oct. 2000, 1-147.

* cited by examiner

POSITION SENSOR FOR A DOWNHOLE COMPLETION DEVICE

PRIORITY INFORMATION

This application claims the benefit of U.S. Provisional Application No. 60/988,460, filed on Nov. 16, 2007.

FIELD OF THE INVENTION

The field of the invention relates generally to methods for the control of oil and gas production wells. Particularly, it relates to a magnetic position sensing system for determining the position of moveable elements in downhole completion equipment used to control well production and other aspects of well operations.

BACKGROUND OF THE INVENTION

In many cases it is desirable to know the position of a moveable element within a downhole tool. This is particularly significant in a downhole flow control device where the position of the moveable element controls the flow into the well. The moveable element in these devices is typically moved by hydraulic or electric means. Without a positive position indication, it is difficult to ensure the moveable element has actually been moved to the desired position. The present invention provides an apparatus for positively determining the position of the moveable element.

In a typical hydraulically actuated intelligent well system, one or more downhole flow control devices are located in a well. These flow control devices are actuated by supplying hydraulic pressure from the surface to move a piston mechanism that in turn causes the moveable element or insert to translate to desired position. To precisely position the flow control device to the desired setting requires feedback as to its actual position. Without this feedback, derived feedback methods are used such as that described in U.S. Pat. No. 6,736,213 to try to determine this position, however the derived feedback methods are limited in their accuracy. What is needed is an actual position sensor installed on the downhole flow control device that transmits the position back to the surface. The present invention overcomes the disadvantages of not having a position indication, or using a derived method to determine the position, and provides positive feedback as to the actual position of the downhole flow control device. This invention has applications in numerous downhole tools that are actuated mechanically, hydraulically or electrically.

Magnetic sensors for determining position have been used as shown in U.S. Pat. No. 5,666,050. One feature of this application is that is senses a response to a single magnet using an individual sensor that is switched on and off. It doesn't take readings from multiple sensors to measure a magnetic field to more precisely determine the movable component location.

U.S. Pat. No. 5,732,776 shows in column 23 line 25 a proximity sensor external to a valve with no details as to the sensor construction or operation. U.S. Pat. No. 6,041,857 uses a resolver connected through a gearbox to compute translation of a sleeve in a tool. This application has limited value where motors are not used to move the downhole component. Details of the sensor appear in column 9 lines 23-46. U.S. Pat. No. 6,334,486 shows the use of position sensors while mentioning a few examples such as linear potentiometers, linear voltage displacement transducers (LVDT), resolvers or a synchro to determine position, as indicated at column 2 lines 43-45. The common feature in these references is the need to mount the position sensor to the moving element or to its driver and mounting the associated electronics that interface with the sensor in the surrounding tool body creates an opportunity for signal distortion.

U.S. Pat. No. 6,848,189 in general describes a caliper measurement device to measure the diameter of a borehole during logging operations. It consists of a curved flexible member with one end fixed and the other sliding in a track as the flexible member is flexed in and out. Sensors are used to detect the position of the sliding end of the member as it moves linearly in the track. From this information, the distance to the apex of the curved member can be calculated.

In column 5, lines 20-55 the sensor array is described. A magnet is attached to the sliding end of the flexible member, and an array of Hall-Effect or other magnetic sensors detects the movement of the magnet. The signals from all the sensors in the array are then used to calculate the position of the magnet by the centroid method.

The preferred embodiment of the present invention also centers on using an array of Hall-Effect sensors to sense the movement of a magnet installed in a moving element such as a choke insert and two or more of the sensor readings are used to calculate the position of the magnet. There are several differences between the described preferred embodiment and the '189 patent. The '189 patent is a caliper device for measuring the diameter of the borehole during logging operations. The linear measurement is an indirect way of measuring this diameter. The preferred embodiment of the present invention involves measuring directly the longitudinal movement of a downhole component such as a sliding sleeve in a choke or a flow tube in a downhole safety valve.

In the '189 patent the magnet is mounted on the O.D. of the tool and is moved along a track by flexure of the curved flexible member. The sensor array is also mounted in a housing on the O.D. of the tool, or alternately sealed in the I.D. of the tool and senses the magnet through the tool wall. In the preferred embodiment of the present invention the magnet is installed in a moveable element (choke insert) in the inside diameter or the side of the tool exposed to tubing pressure. The magnet is moved along with the entire insert as the choke setting is changed. There is no track. The sensor array can be sealed in a housing on the O.D. of the tool. The magnetic field is sensed through both the housing wall and the tool body. In alternate embodiments to the preferred embodiment, the sensor array is mounted in the outer tool body and the magnet is sensed through the tool body. The sensor array is separated from the magnet by the tool body such that there is no need for a physical connection between the array and the moving element.

In the '189 patent, column 5, lines 37-42, it states that as the magnet moves, it also rotates, and therefore the magnetic field also rotates. This effect has to be compensated for during calibration. In the preferred embodiment of the present invention, the magnet preferably does not rotate or change orientation as it moves. The orientation of the magnet's north and south poles are preferably held fixed relative to the axis of the tool as shown in FIG. 6. Compensation for magnet rotation is made unnecessary.

Finally the '189 patent uses the "centroid" technique to calculate the position from the sensor readings. This is described in column 5, lines 46-53. It utilizes the output from all of the sensors in the array to calculate the position. The preferred embodiment of the present invention uses 2 or more sensor readings to determine the position, focusing on just the outputs from the sensors that are actually responding the magnetic field to determine the position. The readings from the sensors that are not sensing the magnetic field are not used. In the example shown in FIG. 9, only readings from sensors 2, 3, and 4 are used to calculate the position as opposed to the technique of the '189 patent where readings from all 8 sensors would be used. Where the position is actually being calculated at the surface, only these 3 sensor readings shown in FIG. 9, for example, would have to be transmitted to the surface, not the readings from the entire array.

SUMMARY OF THE INVENTION

The position of a movable downhole component such as a sleeve in a choke valve is monitored and determined using an array of sensors, preferably Hall Effect sensors that measure the strength of a magnetic field from a magnet that travels with the sleeve. The sensors measure the field strength and output a voltage related to the strength of the field that is detected. A plurality of sensors, with readings, transmits signals to a microprocessor to compute the magnet position directly. The sensors are in the tool body and are not mechanically coupled to the sleeve. The longitudinal position of the sleeve is directly computed using less than all available sensors to facilitate the speed of transmission of data and computation of actual position using known mathematical techniques.

DETAILED DESCRIPTION OF THE PREFERRED EMBODIMENT

Figure 1:
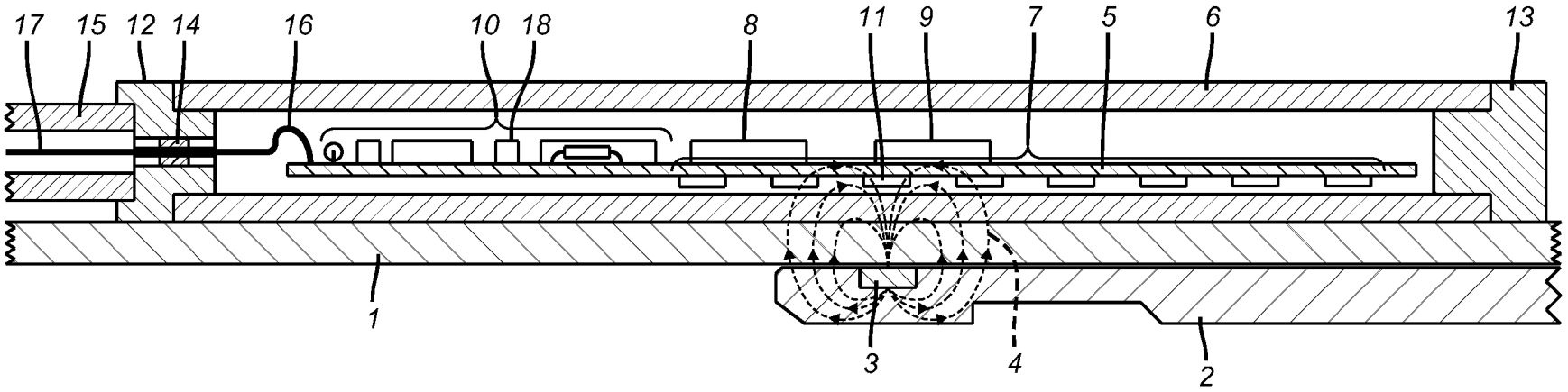
FIG. 1 is a schematic section of a sliding sleeve valve assembly that includes the position sensing device.

In one preferred embodiment, the moveable element is part of a remotely actuated sliding sleeve type flow control device. Referring to FIG. 1, tool body 1 is a tubular element attached on the upper end to the production tubing string (not shown) and is thus fixed in place within the well. The lower end contains a series or slots (not shown) arranged around the circumference. Insert 2 is a tubular element enclosed within a tool body 1. The lower end of insert 2 contains a series of slots (not shown) around the circumference arranged to align radially with the slots in tool body 1. A series of seals (not shown) seal off the annular area between the tool body 1 and insert 2 above and below the slots in tool body 1. When an external actuation force is applied to the device, insert 2 moves axially within tool body 1. At one end of the movement range of insert 2, the slots in tool body 1 and insert 2 are aligned allowing flow between the formation and the well. When insert 2 is located at other end of its movement range, the slots in insert 2 are isolated from the slots in tool body 1 by the seals in the annular area and no flow to or from the formation is possible. If the insert 2 is moved to an intermediate position, the slots in tool body 1 and insert 2 will only partially overlap. The effective flow area through the device can be adjusted by varying the overlap of the tool body 1 and insert 2 slots, and thus allowing control of the flow between the formation and the well.

Tool body 1 is preferably made from a material with low magnetic permeability such as nickel alloy 718. Insert 2 may be made of either a low or high magnetic permeability material. Magnet 3 is installed in insert 2 with its' south pole oriented toward the OD of the device. Magnet 3 produces a magnetic field that is illustrated by flux lines 4. Sensor board 5 is enclosed within electronics housing 6. Sensor board 5 contains sensor array 7, multiplexer 8, de-multiplexer 9, controller assembly 10 and temperature sensor 18. Sensor array 7 comprises multiple linear Hall-Effect sensors 11 evenly spaced and arranged axially along the route of travel of insert 2. The low magnetic permeability material utilized to construct tool body 1 allows the magnetic field from magnet 3 to reach individual Hall-Effect sensors 11 in the sensor array 7.

Figure 2:
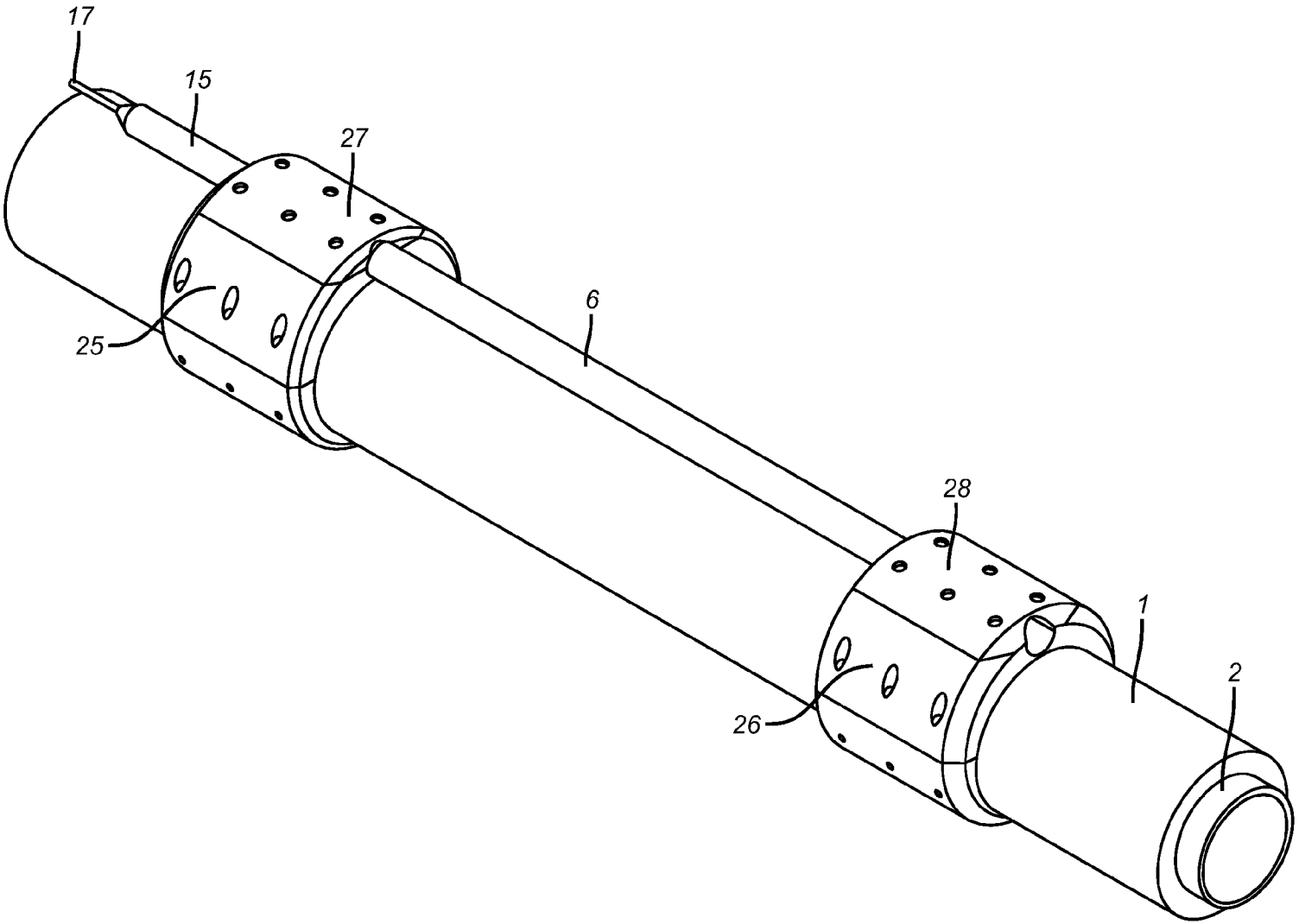
FIG. 2 is an isometric view of a section of the sliding sleeve valve assembly with the position sensing device.

Referring to FIG. 2, electronics housing 6 is a sealed tubular container made from a low magnetic permeability material such as nickel alloy 718 mounted on tool body 1 with an upper clamp assembly 25 and a lower clamp assembly 26. Insert 2 is contained within tool body 1. Electronics housing 6 is aligned axially and radially with the magnet (not shown in this view) installed in insert 2. A cable head assembly 15 provides a means to connect to wire umbilical 17 running to a surface controller (not shown).

Referring back to FIG. 1, electronics housing 6 is sealed with upper end cap 12 and lower end cap 13. This seal is preferably achieved by welding upper end cap 12 and lower end cap 13 to electronics housing 6, but may also be achieved by other well-known methods, such as elastomeric seals, non-elastomeric seals, or metal-metal seals. The output of the controller assembly 10 is routed to wire 16. Upper end cap 12 is joined to cable head 15 and contains a feed through assembly 14 to facilitate connection of wire 16 to wire umbilical 17. Wire umbilical 17 is routed to the surface and is connected to a surface controller (not shown).

Alignment and correct positioning of electronics housing 6 to tool body 1 insures accuracy of the system. Referring to FIG. 2, upper and lower clamp assemblies 25 and 26 have removable upper covers 27 and 28. Removable upper covers 27 and 28 allow electronics housing 6 to be removed from upper and lower clamp assemblies 25 and 26. This allows easy access to cable head 15 to facilitate connection to wire umbilical 17. Upper and lower clamp assemblies 25 and 26 remain firmly attached and locked in place to tool body 1 while electronics housing 6 is removed. Upper and lower clamp assemblies 25 and 26 contain an orienting feature that ensures electronics housing 6 is precisely located in the same position when reinstalled.

Referring back to FIG. 1, sensor board 5 is securely attached to electronics housing 6 to prevent movement of the sensor array 7 in relation insert 2 and to insure correct orientation of the sensor array to magnet 3. Sensor board 5 may be secured in the housing using any of several well-known techniques and the mounting method is therefore not shown. Sensor array 7 is preferably mounted as close as possible to the bottom of electronics housing 6 so that Hall-Effect sensors 11 are in close proximity to magnet 3. Sensor array 7 spans the range of movement of magnet 3 over which it is desired to measure the position of the insert.

In a different equivalent embodiment of the system, sensor array 7 can be attached to the moveable element, and magnet 3 can be located in the tool body 1.

While an array of eight sensors is shown, it is readily apparent that the array can be of any number of sensors 11 as required to fully cover the desired range of movement of insert 2. Likewise, while all the electronic components are shown located on a single board, they may be dispersed on two or more boards as required to facilitate packaging within the device.

The downhole controller assembly 10 is micro-processor or micro-controller based system. It consists or one or more micro-processors or micro-controllers and associated components as required to perform tasks of interrogating the sensor array, processing the sensor data, communicating with the surface controller, and any other control functions required for the downhole device. The communication with the downhole controller 10 can either be a direct communication between the individual downhole device and the surface controller, or as a part of a larger downhole data acquisition and control system that includes other downhole devices such sensors and remotely actuated flow control devices.

Figure 3:
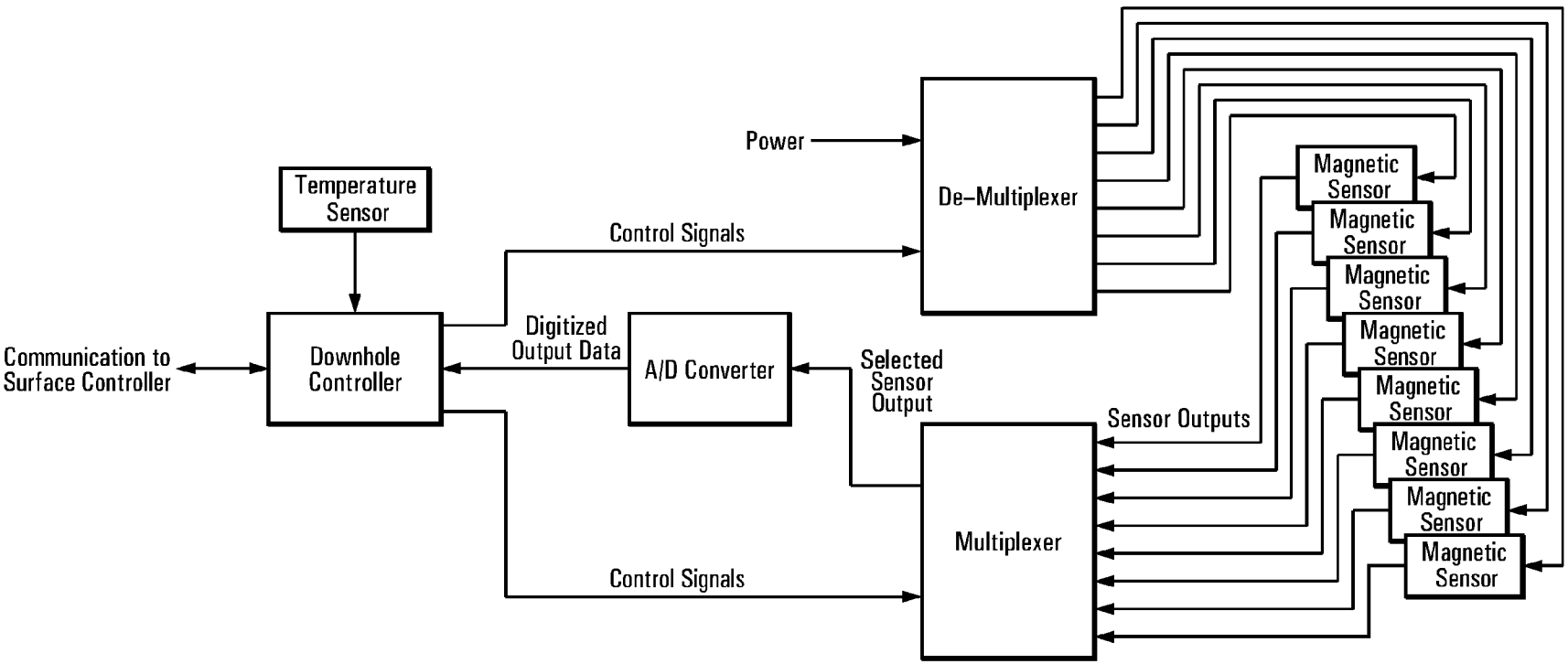
FIG. 3 is a simplified block diagram of the electronic components of the system.

Referring to FIG. 3, the sensor array is connected to an A/D converter through a multiplexer. The output of the A/D converter is connected to the downhole micro-controller. The A/D converter may be a separate component or an integrated feature of the micro-controller itself. The power to the sensor array is routed through a de-multiplexer. This allows the sensors 11 to be individually turned on when required to minimize the power required by the sensor array. Control signals from the downhole controller provide the addressing input to both the multiplexer and de-multiplexer. To determine the position of the magnet, the controller sends the address of the first sensor to the de-multiplexer. The de-multiplexer then enables the output to the first sensor thus supplying power to the sensor. The downhole controller then supplies the address of the first sensor to the multiplexer and enables its output thus routing the output of the first sensor to the A/D converter. The A/D converter then digitizes the sensor's output and sends it to the downhole controller. The downhole controller then disables the multiplexer and de-multiplexer thus powering down the first sensor. The downhole controller repeats this process for all sensors in the array. After all the sensors have been read, the downhole controller transmits the raw data values to a surface controller for processing, or alternately calculates the actual position from the acquired values before transmitting the actual position to the surface.

The magnetic field produced by the magnet and the sensitivity of sensors may both be affected by changes in temperature. A temperature sensor may be added to the system as indicated in FIG. 3 to allow for temperature compensation to be applied to the sensor readings. This sensor may be a thermistor, RTD or any other temperature sensing device.

Figure 4:
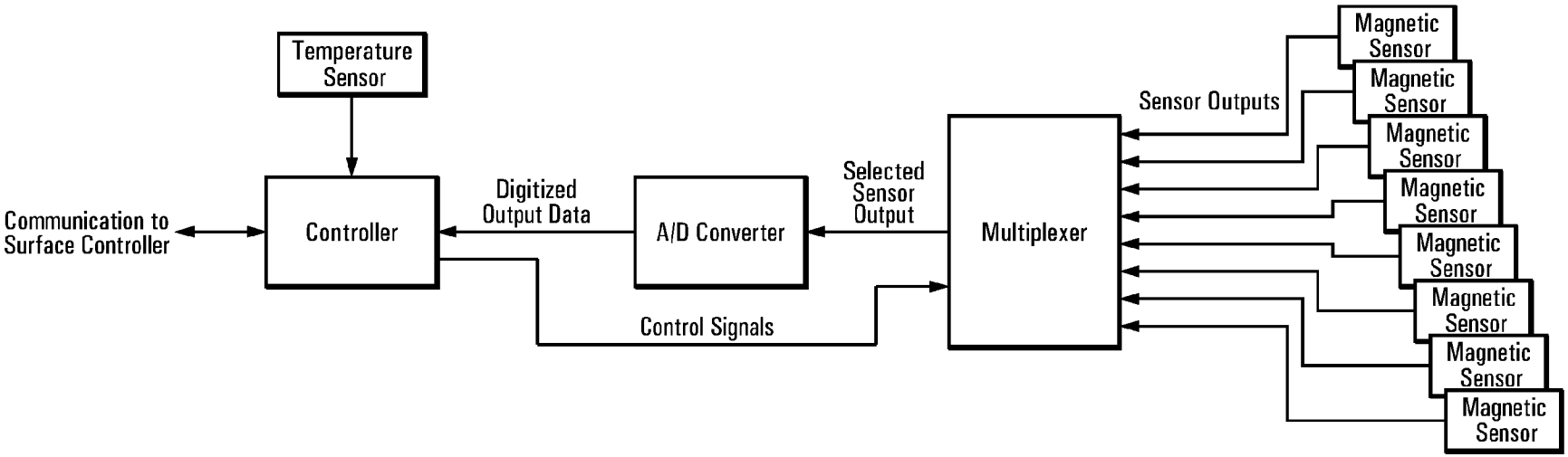
FIG. 4 is the view of FIG. 3 showing an alternative embodiment without a de-multiplexer.

While one preferred embodiment includes a de-multiplexer to switch power to the sensors, this may be eliminated and the sensors would be powered on at all times. FIG. 4 is a simplified block diagram of the electronic components for this embodiment.

Linear Hall-Effect sensors are devices that respond to magnetic fields. Most linear Hall-Effect sensors are ratiometric where their output voltage and sensitivity are proportional to the supply voltage. The quiescent output voltage is typically ½ the supply voltage. The Hall-Effect sensor is also sensitive to the polarity of the magnetic field. In the presence of a south magnetic field, the output will increase. In the presence of a north magnetic field, the output will the decrease. The change in output is proportional to the change in flux density of the applied magnetic field.

Figure 5:
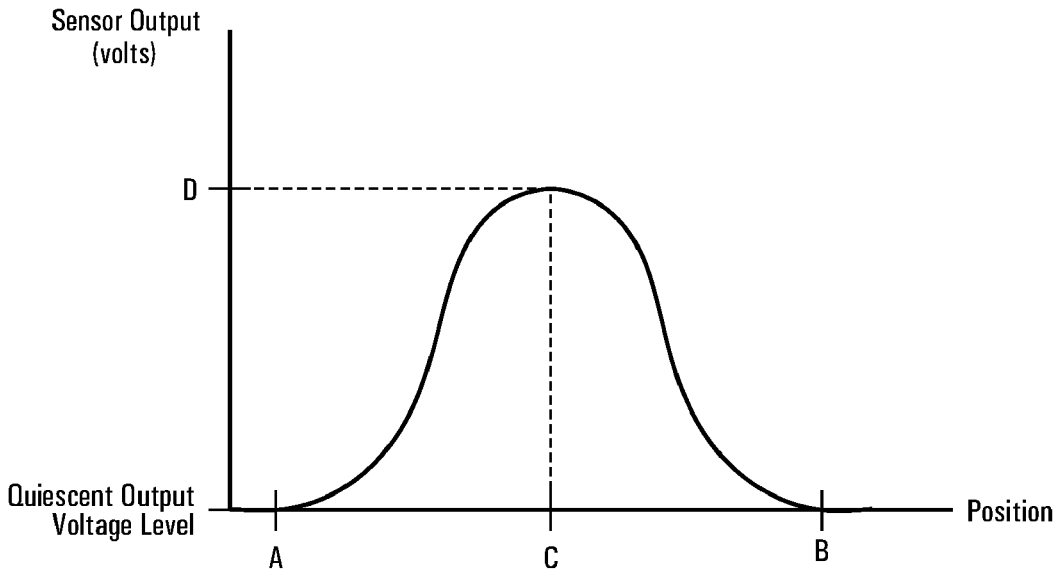
FIG. 5 is a graph of the output response of a typical linear Hall-Effect sensor as a magnet with its South pole oriented toward the sensor as it is moved linearly past it.

Referring to FIG. 5, the vertical scale is the sensor output and the horizontal scale is the magnet position. The graph is adjusted so that the horizontal scale is coincident with the sensor's quiescent output voltage. Points A and B represent the limits at which the sensor will respond to the magnet. D is the amplitude of the sensor output when the magnet is centered under the sensor at point C. At locations A and B the sensor output is essentially equal to the sensor's quiescent output voltage. The location of A and B, and the magnitude of D are a function of the size, shape, and field strength of the magnet, the sensitivity of the sensor, and the distance between the sensor and the face of the magnet.

Figure 6:
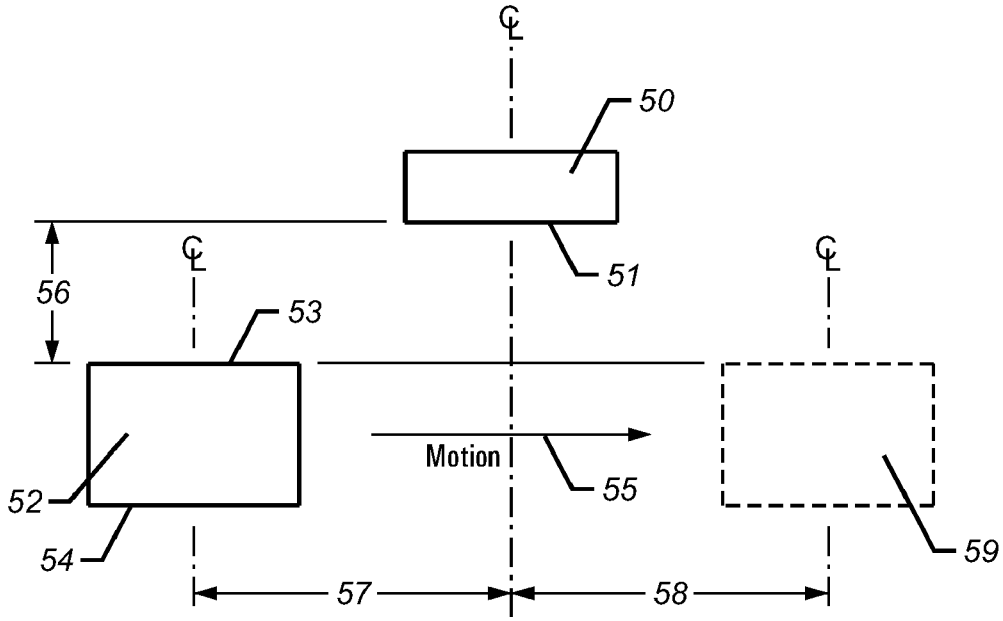
FIG. 6 is a simplified schematic of showing the relationship between the magnet and a single Hall-Effect sensor.

Referring to FIG. 6, sensor 50 is mounted at a fixed location with its sensing face 51 oriented normal to its centerline in the direction of the magnet. Magnet 52 is mounted in the moveable element such that its south pole face 53 is oriented normal to its centerline in the direction of the sensor. As the magnet moves along its path 55, the distance 56 between the plane of south pole face 53, and the plane of sensing face 51 is held constant. When magnet 52 is distance 57 from the centerline of the sensor, the sensor 50 begins to respond to the magnet. Distance 57 corresponds to point A in FIG. 5. As magnet 52 moves toward the centerline of sensor 50, its output continues to increase. Sensor 50's output reaches its maximum when magnet 52 is aligned with sensor 50's centerline. This corresponds to point C in FIG. 5. As the magnet continues to move, sensor 50's output continues to drop until its output reaches its quiescent voltage at distance 58. This corresponds to point B in FIG. 5. While this embodiment utilizes a magnet with its south face oriented toward the sensor, it can be easily seen that the system can also be implemented with the magnetic north face oriented toward the sensor. In this case the waveform shown in FIG. 5 would be inverted with the sensor's output voltage dropping below the quiescent voltage as it responds to the magnetic field.

Referring back to FIG. 1, the linear Hall-Effect sensors 11 produce an analog voltage output that is proportional to the applied magnetic field. As insert 2 traverses through its movement range, the magnetic field seen by each sensor in the sensor array 7 varies. As magnet 3 approaches the location of an individual sensor, the magnetic field 4 at that sensor increases and correspondingly, the output voltage of the sensor increases. At the point where magnet 3 is centered directly under an individual sensor, the magnetic field 4 seen by that sensor reaches its maximum, and correspondingly the sensor's output voltage reaches its maximum. As magnet 3 passes the sensor and begins to move away, the magnetic field at the sensor begins to drop and the sensor's output voltage also begins to drop.

Figure 7:
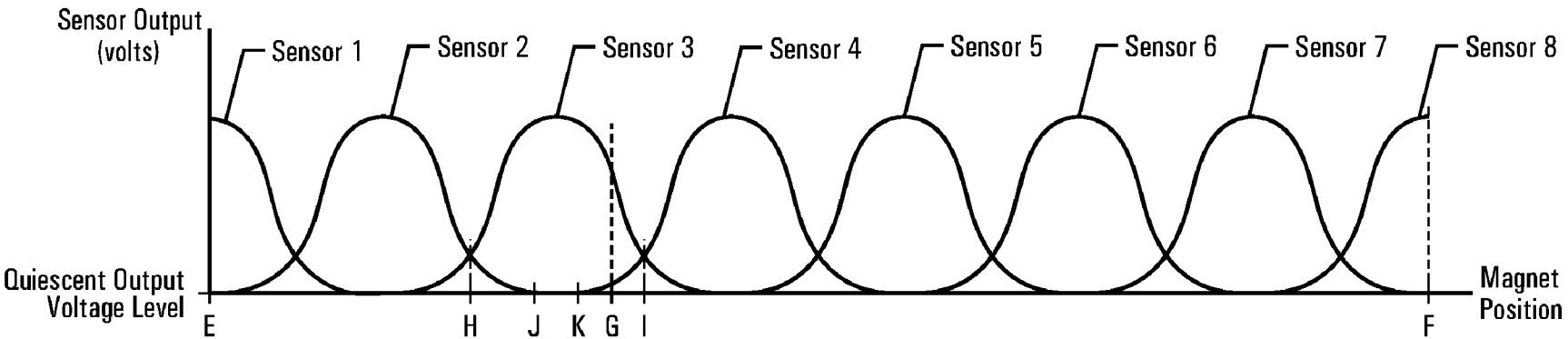
FIGS. 7, 8, and 9 are graphs of the output response of an array of typical linear Hall-Effect sensors as a magnet is moved linearly along the array.
Figure 8:
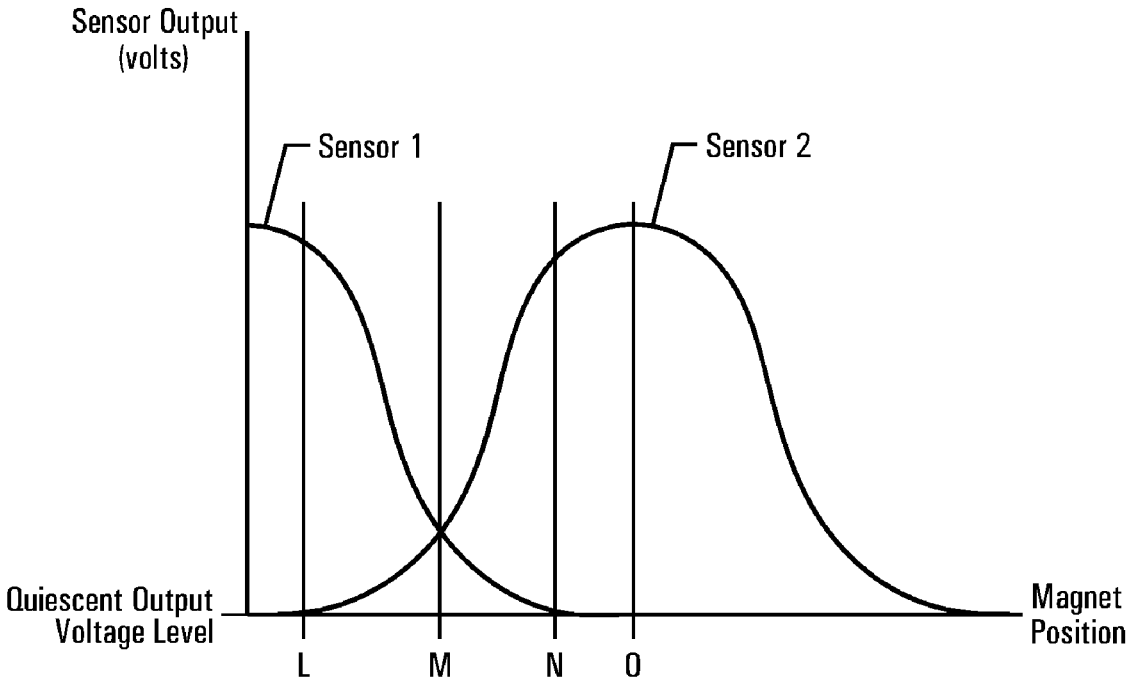
Figure 9:
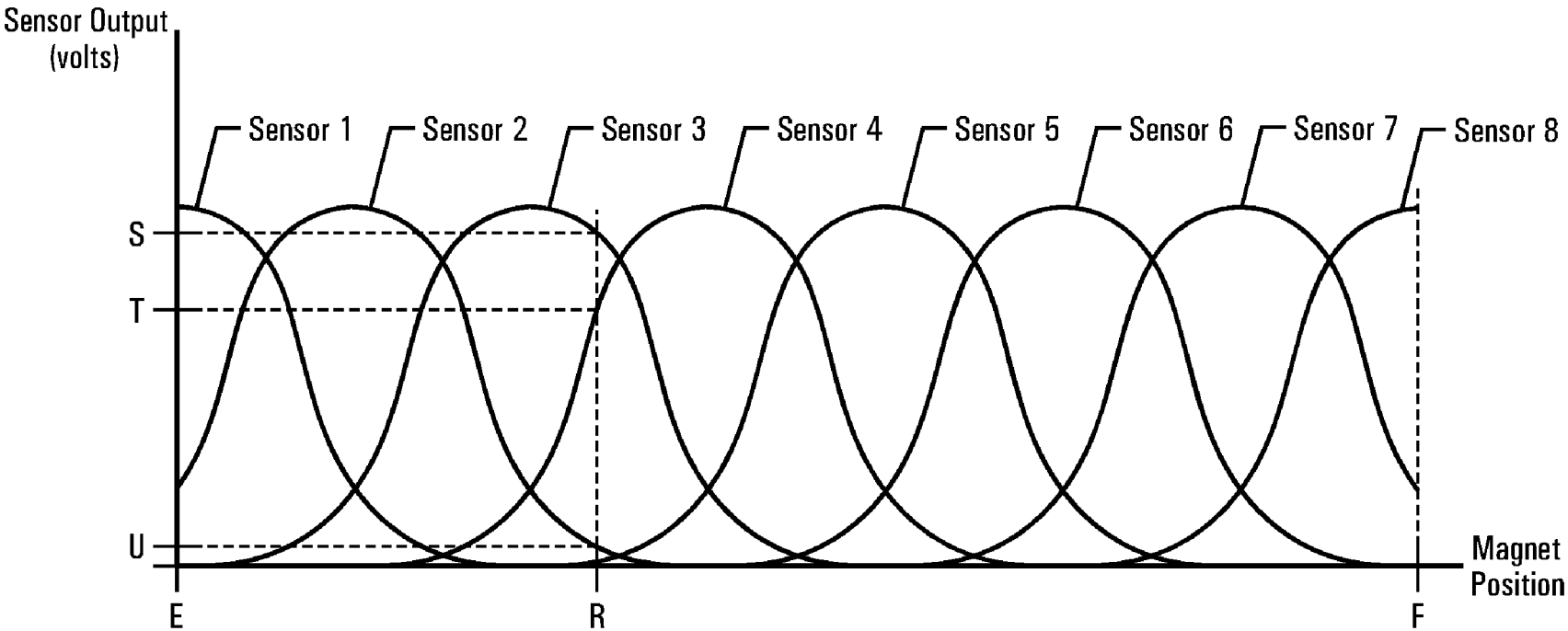

FIGS. 7, 8, and 9 are graphs of the output response of an array of typical linear Hall-Effect sensors as a magnet is moved linearly along the array. The vertical scale is the sensor output; the horizontal scale is the magnet position. The graphs are adjusted so that the horizontal scale is coincident with the sensor's quiescent output voltage. In FIG. 7, a graph of the output voltage of an eight sensor array versus the magnet position is illustrated. In this example, point E represents one end of the magnet's travel range and point F represents the other end. Sensor 1 is centered on point E and Sensor 8 is centered on point F. As the magnet moves from E to F it traverses past each sensor in the array. Initially with the magnet at location E, Sensor 1's output is at its maximum value. As the magnet moves toward F, the output of Sensor 1 begins to drop.

Referring to FIG. 8, this graph illustrates only the first two sensors in the array. As the magnet continues to move Sensor 1's output continues to fall. When the magnet reaches location L, Sensor 2 also begins to respond to the magnetic field; however the magnitude of Sensor 1's output is still greater. Location M is the point equidistant between the two sensors. After the magnet passes location M, the magnitude of Sensor 2's output is greater than Sensor 1's. As the magnet continues to move, Sensor 2's output continues to increase and Sensor 1's continues to drop until location N is reached and Sensor 1 no longer responds to the magnetic field. As the magnet continues to traverse, Sensor 2's output continues to increase until the magnetic is centered under the Sensor 2 at location O. After the magnet passes this point, Sensor 2's output begins to drop. This behavior is repeated as the magnet travels past each of the sensors in the array.

This repeatability of the sensor response to the magnetic field can be utilized to calculate the position of the magnet using any of several methods.

The simplest method utilizes the location of the sensor with the maximum output to determine the magnet location. Referring back to FIG. 7, when the magnet is at location G, both Sensor 3 and Sensor 4 will respond to the presence of the magnetic field. The magnitude of Sensor 3's output is greater than Sensor 4's and it can therefore be readily determined that the magnet is closer to Sensor 3 than Sensor 4. Utilizing the simple technique of determining that Sensor 3 has the maximum output of the eight sensors in the array, the position of the magnet can be resolved to be between locations H and I. The resolution achieved with this technique can be seen to be equal to the sensor spacing.

The resolution can be further increased by utilizing the values from multiple sensors to determine the position. In the simplest method the values of the two highest sensors are compared to increase the resolution to less than the sensor spacing. Referring again FIG. 7, with the magnet centered at location G, Sensor 3 has the largest output of the sensors in the array. If Sensor 3 is the only sensor showing a response to the magnet, the magnet location can be determined to be between J and K. If Sensor 2's output also showed a response, the magnet location would be between J and H. In this example, the magnet is actually located at G and Sensor 4 would also respond to the magnetic field and Sensor 2 would not. The location can therefore be resolved to between K and I.

The accuracy and resolution can be maximized by adjusting the spacing and sensitivity of the sensors, the size, shape, and field strength of the magnet, and the distance between the sensor and the face of the magnet to ensure that 2 or more sensors show a response to the magnetic field at all times. FIG. 9 illustrates this case. In this example, these parameters have been adjusted so that at least three sensors are responding to the magnetic field at all times. With the magnet at location R, Sensor 3 will have an output value of S, Sensor 4 will have an output value of T, and Sensor 2 will have an output value of U. By accurately characterizing the sensor output responses during the manufacturing process, the magnet position can be accurately calculated mathematically from the three sensor output values using any of several known techniques to those skilled in the art. Similar algorithms can be used to utilize any number of overlapping sensor responses.

While one preferred embodiment utilizes linear Hall-Effect sensors in the sensor array, another embodiment utilizes Hall-Effect switches. These switches are devices that provide logic level outputs to indicate the presence of a magnetic field. When a sufficiently strong magnetic field is present, the output will toggle. When the field strength has dropped below the required level, the output would toggle from the previous state. In this embodiment, the A/D converter is not required in the controller.

Figure 10:
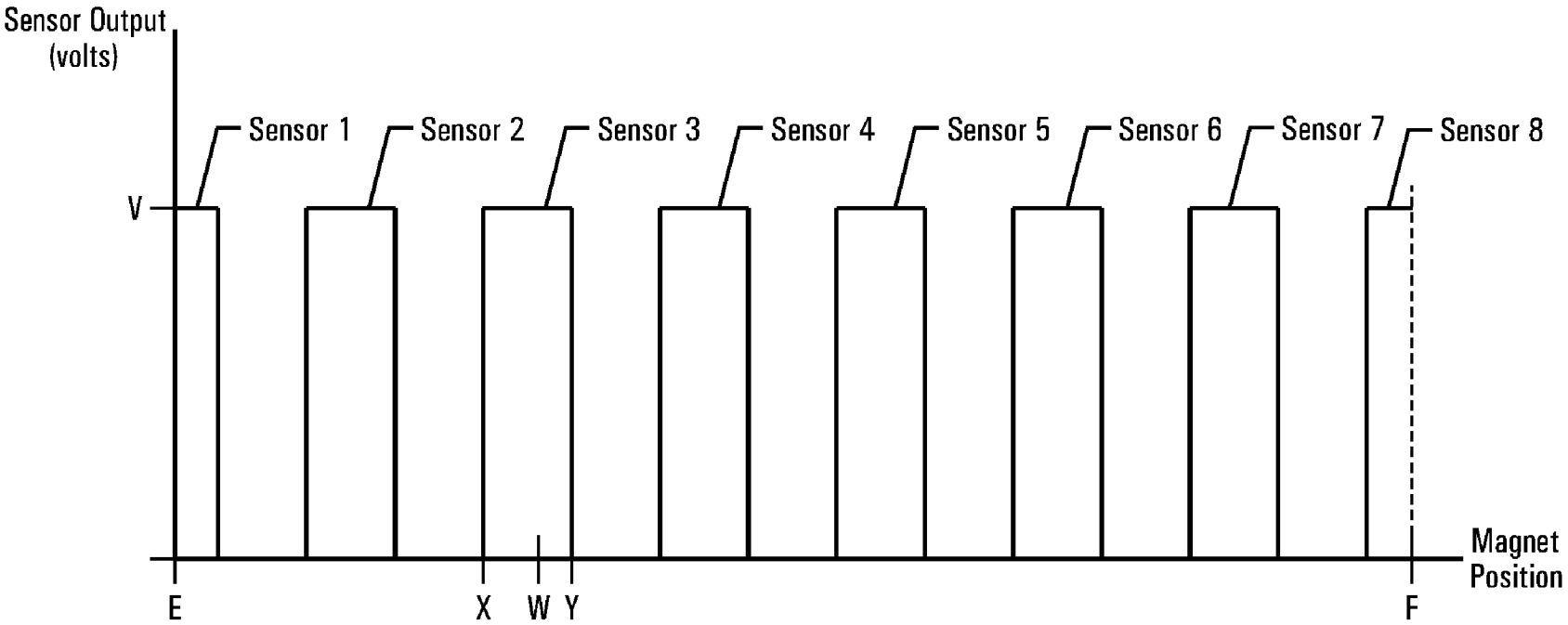
FIG. 10 a graph of output voltage of an eight sensor array versus the magnet position where the sensors are Hall-Effect switches.

In FIG. 10 a graph of output voltage of an eight sensor array versus the magnet position is illustrated. The sensors in this array are Hall-Effect switches. The vertical scale represents the output voltage of the sensors. The horizontal scale represents the position along the range of travel of the magnet. Position E represents one end of the magnet's travel range and point F represents the other end. As the magnet passes each sensor in the array, its output switches on with an output voltage V and then switches off when the magnet has traveled sufficiently far enough past the switch. Uses this repeatable response of the sensors to the magnet, the position of the magnet can be calculated when it is sufficiently close to one of the sensors. When the magnet is at location W, sensor 3's output is on and the position can thus be resolved to be between positions X and Y. A limitation of this method is that if the magnet is not sufficiently close to a sensor to cause a response, the position can not be resolved at that location.

Figure 11:
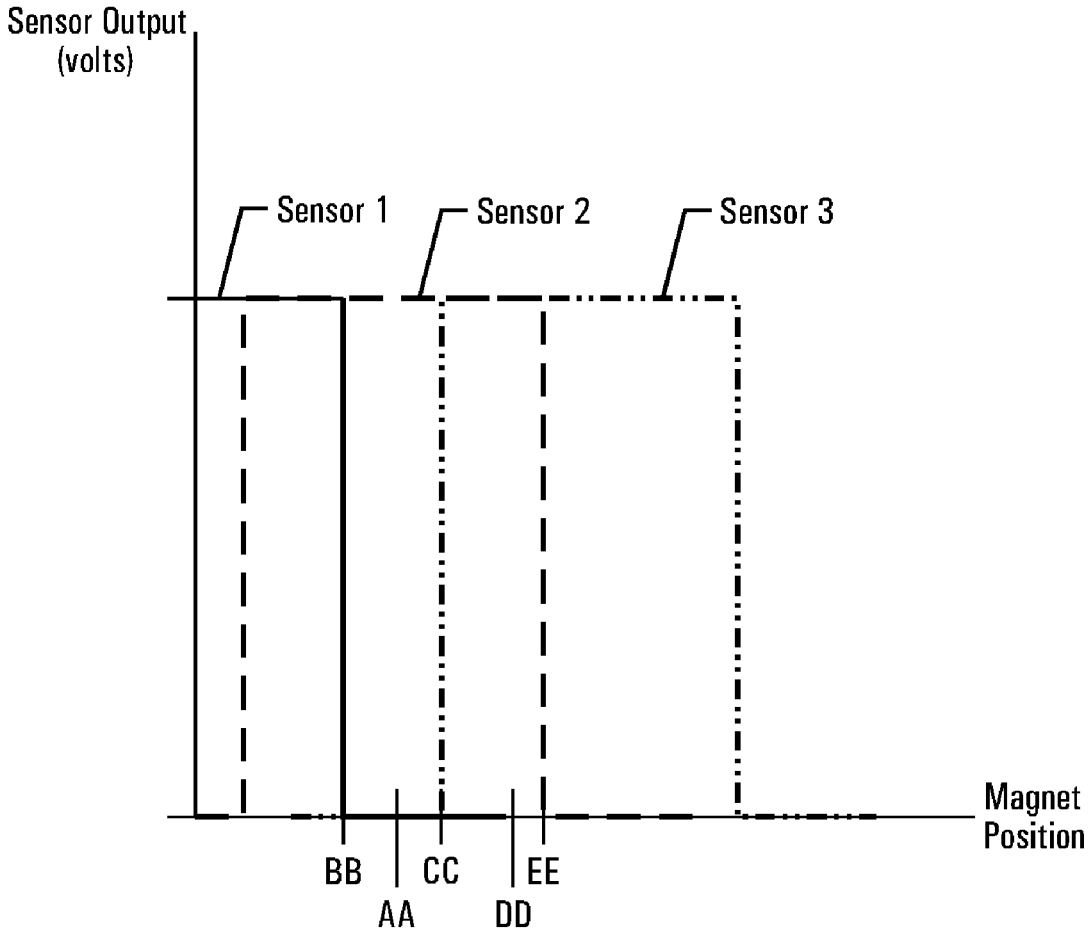
FIG. 11 is a modification of FIG. 10 showing the switches moved to a closer spacing.

By spacing the Hall-Effect switches sufficiently close together so that the positions at which each sensor responds overlaps, this limitation can be overcome. FIG. 11 is a detail of the output responses of the first three sensors in the array. In this example, the sensors response ranges overlap. This provides both an increase in resolution and eliminates the locations where the position can not be resolved. When the magnet is at position AA, Only sensor 2 is on, and sensors 1 and 3 are off, therefore the position can be resolved to be between locations BB and CC. When the magnet is at position DD, the output of both sensors 2 and 3 is on, and sensor 1 is off, therefore the position can be resolved to be between CC and EE. Similar placements can be used to utilize any number of overlapping sensor responses.

Figure 12:
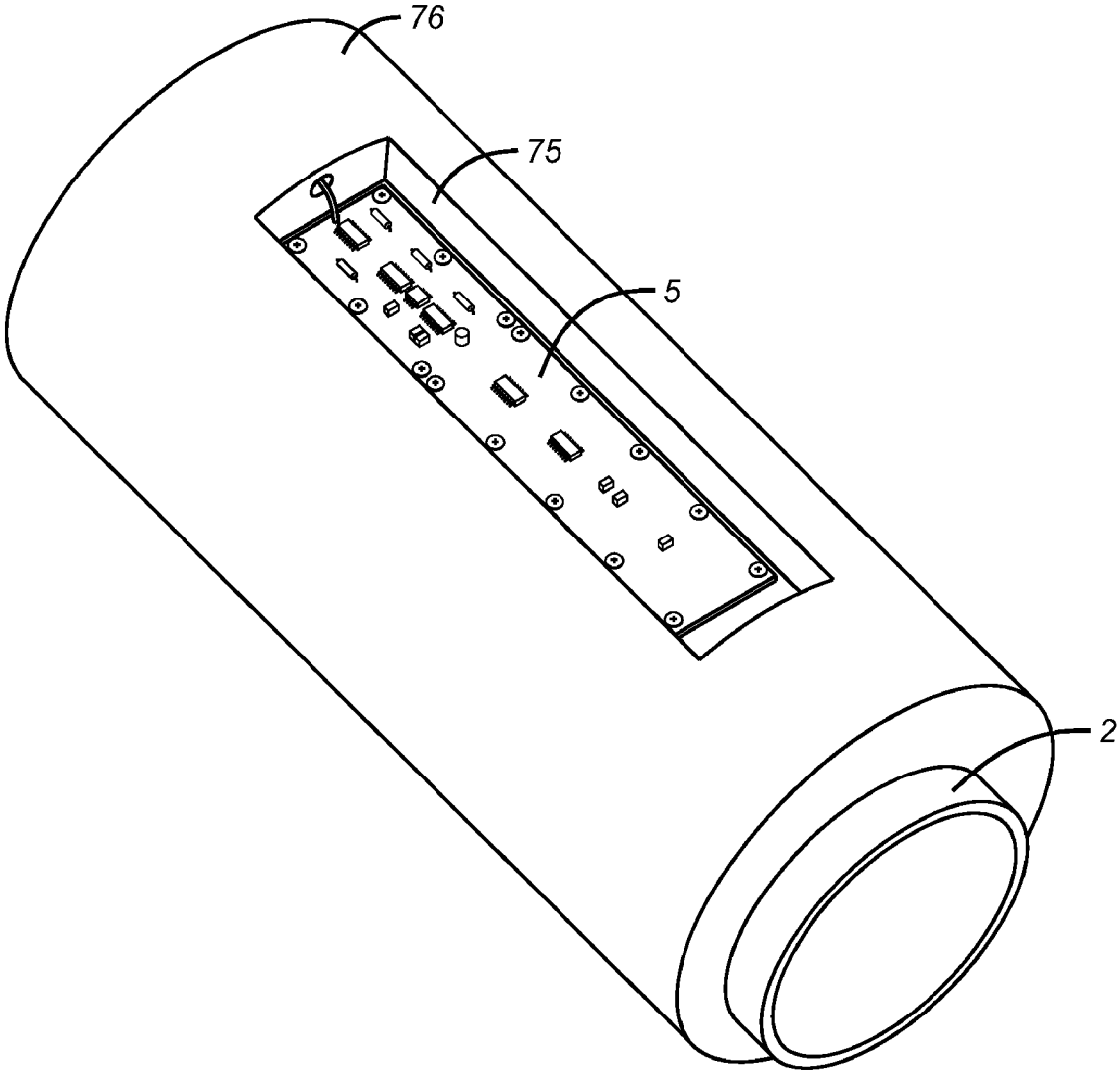
FIG. 12 is a view of a portion of the tool with the cover removed.
Figure 13:
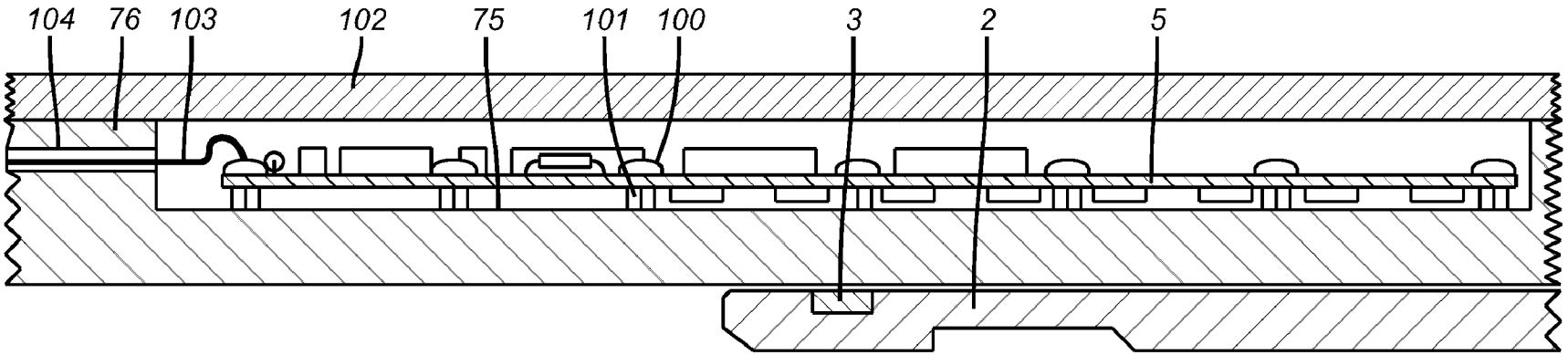
FIG. 13 is a section view of the tool shown in FIG. 12.

In another embodiment, the sensor array is mounted in a sealed recess in the body of the downhole tool. FIG. 12 is a view of a portion of the tool with the cover removed. Sensor board 5 is mounted in recess 75 in tool body 76. Insert 2 moves axially within tool body 76. Referring to the section view in FIG. 13, Sensor board 5 is mounted to base of recess 75 in tool body 76 by screws 100 and standoffs 101, or similar well known techniques. Cover 102 seals off recess 75. A seal may be achieved by any of a number of well known techniques including welding, elastomeric seals, non-elastomeric seals, or metal-to-metal seals. Magnet 3 is located in insert 2 and translates axially under the sensor array. Wire 103 exits recess through a passage 104 bored through tool body 76.

Figure 14:
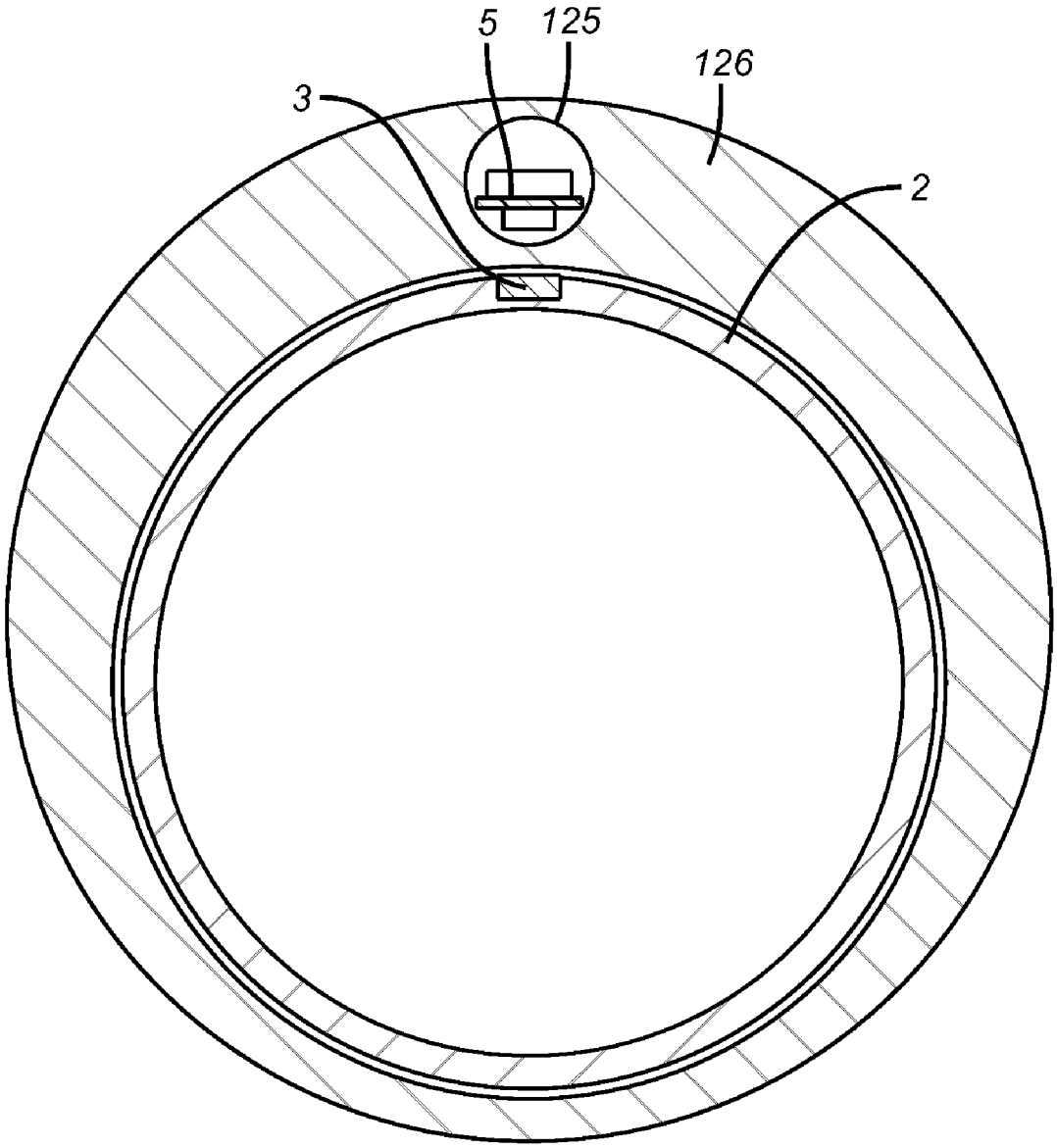
FIG. 14 is an alternative embodiment to FIG. 12 showing the sensors in a bore in the wall of the tool.

In another embodiment, the sensor array is mounted in a sealed bore in the tool body. Referring to cross section FIG. 14, bore 125 is located in tool body 126. Sensor board 5 is located within bore 125. Magnet 3 is installed in insert 2 and translates axially under the sensor array. The bore is sealed with a cable head (not shown). The cable head may be welded to tool body 126, or threaded into tool body 126 and the seal made by elastomeric seals, non-elastomeric seals, or metal-to-metal seals.

Figure 15:
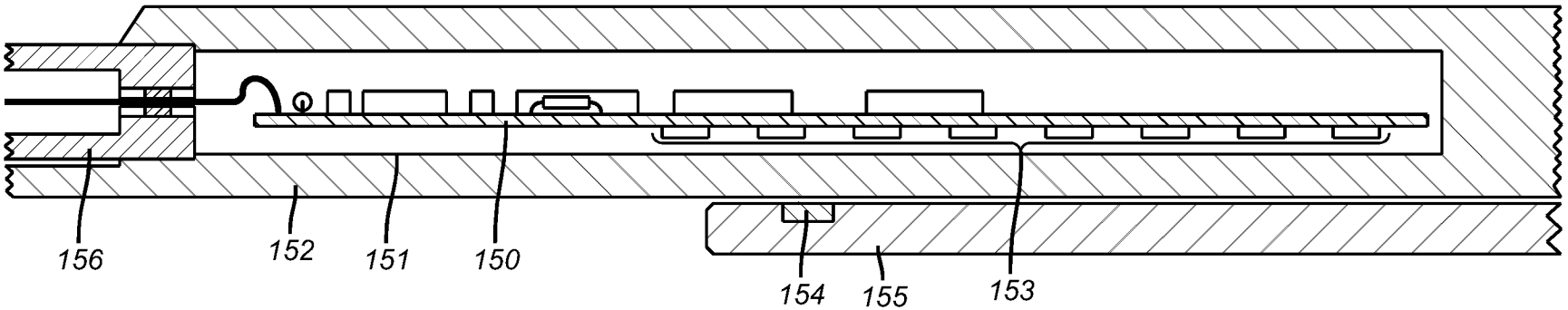
FIG. 15 is an alternative embodiment for a subsurface safety valve.

The magnetic sensor array may be used to indicate the state of a safety valve. In this embodiment the movement of the flow tube is measured to determine if the safety valve is in the closed, equalizing, or open positions, or in an intermediate position. FIG. 15 is a schematic representation of a portion of a typical safety valve. Sensor and electronic board 150 is mounted in bore 151 in tool body 152. Sensor array 153 is oriented toward the ID of the tool. Magnet 154 is installed in flow tube 155. Cable head 156 seals the end of the bore and facilitates a connection to the surface. Magnet 154 translates axially under sensor array 153 as the flow tube is shifted from closed to equalizing to open positions. The position of the flow tube can be determined from the sensor responses as previously described. In another embodiment, the sensor array may be mounted in a smaller bore and the controller may be remotely mounted on another portion of the safety valve, or on a sub above it.

The sensor array may also be used to determine the extension of an expansion joint. An expansion joint consists of an inner element that moves axially within an outer element to allow for dimensional changes in the length of the production tubing string. In this embodiment, the magnet is installed in the inner element and the sensor array is installed on the outer element. As the inner element and magnet translates through their movement range, the sensor response is monitored and the position of the magnet and thus the extension is calculated as previously discussed.

Figure 16:
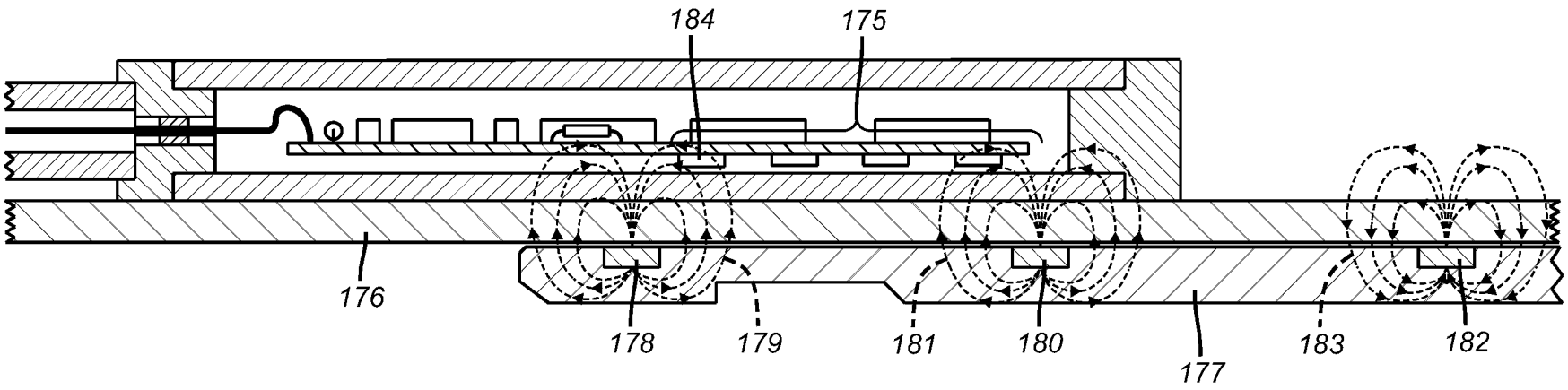
FIG. 16 is an alternative embodiment where the array length is shorter than the magnet travel range.

In the previous embodiments the sensor array preferably spans the entire distance across which it is desired to measure position. In certain applications it may advantageous to have a shorter sensor array. FIG. 16 represents an embodiment in which a shorter sensor array is utilized on a remotely actuated sliding sleeve type flow control device. Sensor array 175 is mounted on tool body 176 above the path of insert 177. A first magnet 178 and a second magnet 180 are installed in the insert. Additional magnets 182 are installed as required to cover the range of travel of the insert over which it is desired to measure the position. These magnets are located so that the magnetic fields 179, 181, 183, of at least one magnet are causing a response in the sensor array at all times. From a known starting position, the position of a magnet traversing under the sensor array can be determined as previously described. By keeping track of how many magnets traverse past the sensor array, the insert position can be accurately determined.

Figure 17:
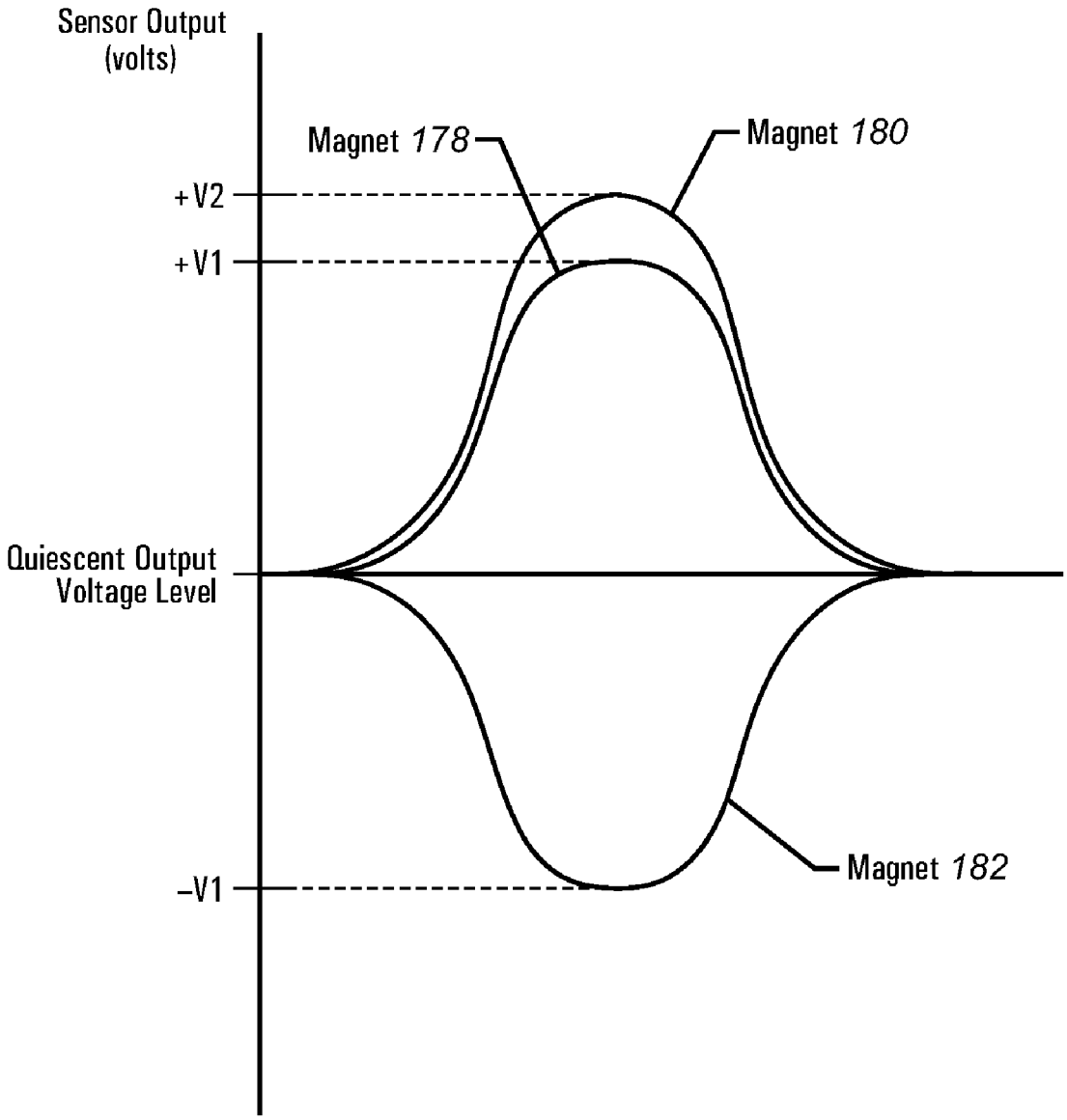
FIG. 17 is a graph of the output response of a typical linear Hall-Effect sensor as magnets of different field strengths and polarities are moved linearly past it.

Another method allows the calculation of the position without having to know the starting position. This can be accomplished by varying the polarity of the magnets, or adjusting their size, shape or material to vary their magnetic field strength. Referring to FIG. 16, magnets 178 and 180 are oriented with their south pole toward the sensor array. Magnet 182 is oriented with its north pole toward sensor array 175. Magnet 180 has been designed to have a greater magnetic field strength than magnet 178. Magnet 182 has approximately the same field strength as magnet 178. Referring to FIG. 17, this is a graph of the sensor response to the three magnets. The maximum sensor output for magnet 178 is +V1. The maximum sensor response for magnet 180 is +V2. The maximum sensor response from magnet 182 is −V1. From this it can be seen that the magnet can be identified from its response curve. Utilizing this technique and the methods previously described, the insert position can be accurately determined. While this example only used three magnets, this technique can be extended out to any number of magnets as required.

An alternative embodiment relates generally to a method of sensing the position of downhole service tools run on electric wireline or coiled tubing in oil and gas production wells. Particularly, it relates to a magnetic position sensing system for determining the position of tools run into the well to perform operations on installed completion components installed in the well.

In many cases it is desirable to know the position of a tool being run into the well on wireline or coil tubing. These tools are run for many reasons. One common example is a shifting tool to shift sliding sleeves. In some cases multiple sliding sleeves of the same sizes are installed. In this case the position of the tool in relation to the sliding sleeves must be known to ensure the correct sleeve is being shifted. The present invention provides an apparatus for positively locating a specific position within a well and monitoring movement of the shifting tool from that point during the operation of the tool.

A series of cylindrical magnets are installed in the tubing string in the well at points where it is desired to provide an accurate position indication. An array of multiple Hall-effect sensors is run into the well on electric wireline or coiled tubing with an internal wireline and detects the magnets. The multiple sensor array provides an advantage over a single sensor by giving a more accurate position indication, and being able to monitor the movement of the tool relative to the magnet while an operation is being performed.

The above description is illustrative of the preferred embodiment and many modifications may be made by those skilled in the art without departing from the invention whose scope is to be determined from the literal and equivalent scope of the claims below:

We claim:

1. A method for controlling a flow of a fluid at a formation zone, comprising:

positioning a plurality of sensors for detecting a magnetic field on one of a fixed component of a downhole tool and a component of the downhole tool movable with respect to the fixed component, wherein the movable component moves with respect to the fixed component to control the flow of the fluid at the formation zone;

positioning at least one magnet on the other of the movable component and the fixed component with a pole of the at least one magnet oriented to face the plurality of sensors;

detecting a field strength of the at least one magnet at two or more sensors of the plurality of sensors;

determining a position of the movable component with respect to the fixed component using the detected field strengths from the two or more sensors; and controlling the flow of the fluid at the formation zone using the determined axial position.

2. The method of claim 1, comprising:

directly measuring linear displacement of the movable component relative to said fixed component.

3. The method of claim 1, comprising:

using a Hall Effect sensor or a Hall Effect switch for at least one of the plurality of sensors.

4. The method of claim 3, comprising:

covering at least a portion of a range of motion of the movable component with sensors or switches.

5. The method of claim 3, comprising:

mounting the plurality of sensors in a downhole tool housing and the at least one magnet in a movable downhole component whose movement is linear relative to said housing.

6. The method of claim 5, wherein the movable component is at least one of: (i) a sliding sleeve, (ii) a safety valve flow tube, (iii) a portion of an expansion joint and (iv) a choke sleeve.

7. The method of claim 3, wherein the at least one magnet comprises a plurality of magnets, further comprising:

determining the current position of the movable component without having to know its previous position by performing one of: (i) varying the polarity of the magnets, (ii) adjusting a size of the magnets, (iii) adjusting a shape of the magnets, and (iv) adjusting the material of the magnets to vary their magnetic field strengths.

8. The method of claim 3, comprising:

adjusting sensor spacing or magnet properties so that at least three sensors detect a signal over the range of movement of the movable component.

9. The method of claim 3, comprising:

directly measuring linear displacement of the movable component relative to said fixed component.

10. The method of claim 9, comprising:

making the sensor or switch response to a transmitter at a given distance either uniform or differing.

11. The method of claim 10, comprising:

covering at least a portion of the full range of motion of the movable component with sensors or switches.

12. The method of claim 11, comprising:

mounting the sensors in a downhole tool housing and at least one magnet in the movable downhole component whose movement is linear relative to said housing.

13. The method of claim 12, wherein the at least one magnet comprises a plurality of magnets, further comprising performing one of: (i) varying the polarity of the magnets, (ii) adjusting a size of the magnets, (iii) adjusting a shape of the magnets, and (iv) adjusting the material of the magnets to vary their magnetic field strengths.

14. The method of claim 1, wherein at least one of the plurality of sensors responds to the at least one magnet by producing a signal selected from the group consisting of: (i) a signal that toggles between an on voltage and an off voltage based on a distance between the at least one sensor and the at least one magnet; and (ii) a signal whose magnitude is related to a distance between the at least one sensor and the at least one magnet.

15. The method of claim 1, comprising:

using a wireline or coiled tubing for the movable component and a tubular string as the fixed component.

16. The method of claim 15, comprising:

mounting the plurality of sensors on the wireline or coiled tubing and the at least one magnet on the tubular string.

17. The method of claim 1, comprising:

sequentially powering up, interrogating each sensor and powering down the plurality of sensors to obtain a signal related to the detected magnetic field strength;

recording the obtained signal taking signals from at least three of the plurality of sensors to compute position of the movable component;

computing the position of the movable component with said signals either downhole or at the surface.

18. The method of claim 1, wherein determining the position of the movable component further comprises providing temperature compensation to correct for an effect of temperature on at least one of (i) magnetic field of the magnet, and (ii) sensitivity of the plurality of sensors.

* * * * *